US010170857B2

(12) United States Patent
Ho

(10) Patent No.: US 10,170,857 B2
(45) Date of Patent: Jan. 1, 2019

(54) ELECTRICAL CONNECTION DEVICE

(71) Applicant: Molex, LLC, Lisle, IL (US)

(72) Inventor: Yi-Tse Ho, Taipei (TW)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/933,562

(22) Filed: Mar. 23, 2018

(65) Prior Publication Data

US 2018/0277990 A1 Sep. 27, 2018

(30) Foreign Application Priority Data

Mar. 27, 2017 (TW) ..... 106204241 U

(51) Int. Cl.

| | |
|---|---|
| ***H01R 13/627*** | (2006.01) |
| ***H01R 9/24*** | (2006.01) |
| ***H01R 12/51*** | (2011.01) |
| ***H01R 13/629*** | (2006.01) |
| ***H01R 12/58*** | (2011.01) |

(52) U.S. Cl.

CPC ..... *H01R 13/6273* (2013.01); *H01R 9/2491* (2013.01); *H01R 12/515* (2013.01); *H01R 12/58* (2013.01); *H01R 13/629* (2013.01)

(58) Field of Classification Search

CPC ..... H01R 13/6271; H01R 13/7023

USPC ..... 439/357, 358

See application file for complete search history.

(56) References Cited

U.S. PATENT DOCUMENTS 4,553,801 A * 11/1985 Zajeski ..... H01R 12/716 439/350
4,820,179 A * 4/1989 Saijo ..... H01R 4/2466 439/224
5,180,312 A * 1/1993 Martin ..... H01R 13/6275 439/357
5,613,870 A * 3/1997 Traver, Jr. ..... H01R 13/6273 439/352
5,951,316 A * 9/1999 Kawano ..... H01R 13/6275 439/352
6,146,181 A * 11/2000 Plaza ..... H01R 9/2491 439/357
6,315,594 B1 * 11/2001 Yanagida ..... H01R 13/6271 439/357

(Continued)

FOREIGN PATENT DOCUMENTS

TW M320218 Y 10/2007
TW I364881 B 5/2012

*Primary Examiner* — Neil Abrams

(74) *Attorney, Agent, or Firm* — James A. O'Malley

(57) ABSTRACT

An electrical connection device comprises: a receptacle connector and a plug connector. The receptacle connector comprises a receptacle body, a front guide-positional limiting portion, a rear guide-positional limiting portion and a first latching member. The plug connector removably mates with the receptacle connector, and comprises a plug body and a second latching member, when the plug connector mates with the receptacle connector, the second latching member of the plug connector is latched to the first latching member of the receptacle connector and limited by the front guide-positional limiting portion, and the rear guide-positional limiting portion of the receptacle connector engages with a recessed portion of the plug connector, so that two side walls of the plug connector are respectively exposed to two side openings of the receptacle connector and generally flush with two side walls of the receptacle connector.

10 Claims, 14 Drawing Sheets

(56) References Cited

U.S. PATENT DOCUMENTS

| | | | | |
|---|---|---|---|---|
| 6,517,372 | B1 * | 2/2003 | Jones | H01R 4/26 439/159 |
| 7,744,398 | B1 * | 6/2010 | Wilkolaski | H01R 13/6275 439/357 |
| 8,282,426 | B2 * | 10/2012 | Zweigle | H01R 13/41 439/499 |
| 8,425,248 | B2 * | 4/2013 | Ohsako | H01R 13/6272 439/353 |
| 9,300,088 | B2 | 3/2016 | Tseng | |
| 2002/0061673 | A1 * | 5/2002 | Ushio | H01R 12/58 439/357 |

* cited by examiner

ELECTRICAL CONNECTION DEVICE

RELATED APPLICATIONS

This application claims priority to Taiwanese Application No. 106204241, filed Mar. 27, 2017, which is incorporated herein by reference in its entirety.

TECHNICAL FIELD

The present disclosure relates to a connector, and more particularly to an electrical connection device.

BACKGROUND ART

In existing electrical connector assembly, for example, U.S. Pat. No. 6,146,181 (corresponding to Taiwanese Patent Application No.TW88119860) discloses a locking electrical connector for locking a plug and a header together. The locking electrical connector has interlocking portions for fixing the plug to the header. Specifically, when the plug and header are connected, the plug is mounted in a travel direction of pins, the pins are received by electrical contact portions respectively via openings of the header and plug. First interlocking portions positioned on a first side of the plug are interlocked with corresponding interlocking portions on a first surface of the header. The first interlocking portions of the plug comprise cams or other similarly shaped protruding members which are received by corresponding receiving portions (on the first surface of the header). Similarly, a second interlocking portion of the header interlocks with a second interlocking portion of the plug.

However, the interlocking structure of the abovementioned locking electrical connector has no function of guiding-positional limiting, therefore, when the plug is inserted into the header, it is easy to improperly insert due to misalignment.

SUMMARY

Therefore, an object of the present disclosure is to provide an electrical connection device which may improve the shortcomings of the prior art.

Another object of the present disclosure is to provide an electrical connection device which may reduce the whole dimension.

Therefore, in some embodiments, an electrical connection device of the present disclosure comprises a receptacle connector and a plug connector. The receptacle connector comprises a receptacle body, a front guide-positional limiting portion, a rear guide-positional limiting portion and a first latching member, the receptacle body comprises a base, a front wall and a rear wall which extend upwardly from the base and two side walls respectively positioned on left and right sides, the base, the front wall and the rear wall cooperate to define a plug receiving space, the two side walls each are formed with a side opening communicating with the plug receiving space, the front guide-positional limiting portion comprises the front wall and a guide groove positioned to the front wall and extending along an inserting direction, the rear guide-positional limiting portion comprises the rear wall and at least one rear guide-positional limiting piece formed to the rear wall, the first latching member is provided to the front guide-positional limiting portion. The plug connector removably mates with the receptacle connector along the inserting direction and comprises a plug body and a second latching member, the plug body has a front wall, a rear wall, two side walls respectively positioned on left and right sides, the rear wall of the plug body is recessed to form a recessed portion, the recessed portion is formed with a guide recessed groove into which the rear guide-positional limiting piece of the receptacle connector extends, the second latching member is provided to the front wall of the plug body. When the plug connector mates with the receptacle connector, the plug body is inserted into the plug receiving space of the receptacle body and limited between the front wall of the front guide-positional limiting portion and the rear wall of the rear guide-positional limiting portion, the second latching member of the plug connector is latched to the first latching member of the receptacle connector and limited by the front guide-positional limiting portion, the rear guide-positional limiting piece of the receptacle body extends into the guide recessed groove and the rear wall engages with the recessed portion of the plug body, the rear wall of the plug connector is generally flush with the rear wall of the receptacle connector, the two side walls of the plug body are respectively exposed to the two side openings of the receptacle body and generally flush with the two side walls of the receptacle body.

In some embodiments, the front guide-positional limiting portion of the receptacle body comprises two front guide-positional limiting pieces extending forwardly respectively from the front wall of the receptacle body, the two front guide-positional limiting pieces and the front wall cooperate to define the guide groove, the first latching member is positioned between the two front guide-positional limiting pieces, when the plug connector mates with the receptacle connector, the second latching member is positioned between the two front guide-positional limiting pieces, and the front wall of the receptacle body is positioned between the front wall of the plug connector and the second latching member.

In some embodiments, the first latching member of the receptacle connector is a latch block protruding from the front wall of the receptacle body, the second latching member of the plug connector defines a latching groove, when the second latching member is latched to the first latching member, the latch block is positioned within the latching groove.

In some embodiments, the second latching member is a general U-shaped structure and surrounds to define the latching groove, and both back ends of the U-shaped structure extend backwardly to connect with the front wall of the plug connector.

In some embodiments, the front wall of the receptacle body is formed with two grooves, the two grooves split the front wall of the receptacle body into two side column portions and the first latching member positioned between the two side column portions, the first latching member comprises an elastic plate portion and a latching block protruding inwardly from an end of the elastic plate portion toward the plug receiving space, the guide groove is formed between an inner surface of the elastic plate portion and the two side column portions; the second latching member is a latch block protruding from the front wall of the plug body.

In some embodiments, a thickness of the elastic plate portion of the first latching member is thinner than a thickness of each of the two side column portions and a width of the second latching member in a left-right direction is smaller than a width between the two side column portions, when the plug connector mates with the receptacle connector, the second latching member of the plug connector is positioned with the guide groove and limited between the two side column portions.

In some embodiments, the rear wall of the receptacle body is formed with the three rear guide-positional limiting pieces, the recessed portion of the plug connector is formed with the three guide recessed grooves.

In some embodiments, the plug body is formed with a plurality of terminal grooves, each terminal groove has a terminal mounting hole and a mating insertion hole which are communicated, the plug connector further comprises plug terminals respectively for fixing to end segments of a pair of cables and mounting in the terminal grooves, each plug terminal comprises a mating portion positioned to the mating insertion hole, a tail portion for clamping and fixing one cable and a stepped connecting portion connecting the mating portion and the tail portion, the mating portion is close to the front wall of the plug body relative to the tail portion and the tail portion is close to the rear wall of the plug body relative to the mating portion, the receptacle connector further comprises receptacle terminals to respectively mate with the mating portions of the plug terminals, when the mating portion of the plug terminal mates with the receptacle terminal, the cable is offset from the receptacle terminal in the inserting direction without contact.

In some embodiments, a position of the recessed portion corresponds to a position of the mating portion of the plug terminal.

In some embodiments, the stepped connecting portion of each plug terminal extends obliquely.

The present disclosure at least has the following effects: the thickness of the elastic plate portion of the first latching member is thinner than the thickness of each of the side column portions, thus the guide-positional limiting portion is formed, and the width of the second latching member in the left-right direction is smaller than the width between the side column portions, when the plug connector mates with the receptacle connector, the first latching member of the plug connector can slip in the guide-positional limiting portion and is limited between the side column portions. The guide recessed grooves of the plug connector are respectively guided and limited by the rear guide-positional limiting pieces of the receptacle connector such that the rear wall of the receptacle connector is received in the recessed portion of the plug connector, and in turn the rear wall of the plug connector is generally flush with the rear wall of the receptacle connector, and the left, right side walls of the plug connector are respectively positioned to the two side openings of the receptacle connector, the left, right side walls of the plug connector are respectively flush with the left, right side walls of the receptacle connector, which in turn the whole dimension of the electrical connection device is reduced. Through the structural design of the stepped connecting portion of each plug terminal, when the mating portion of the plug terminal mates with the receptacle terminal, the conductor of the cable is offset from the receptacle terminal in the inserting direction without contact, which helps to make the dimension of each plug terminal short.

BRIEF DESCRIPTION OF THE DRAWINGS

The other features and effects of the present disclosure will be apparent in the detailed description in combination with the accompanying figures, and in which.

DETAILED DESCRIPTION OF THE PREFERRED EMBODIMENTS

Figure 1:
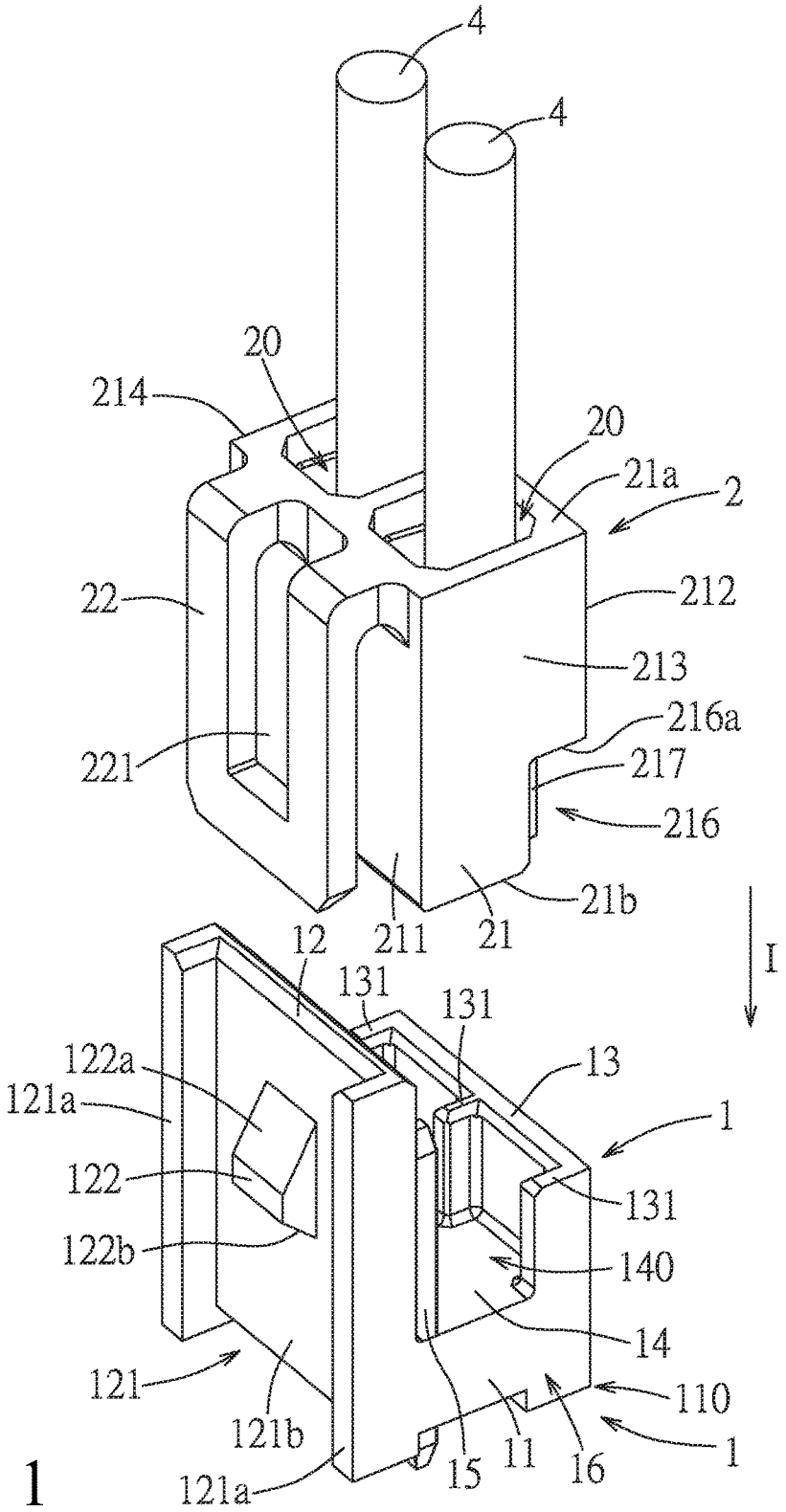
FIG. 1 is an exploded perspective view of a first embodiment of an electrical connection device of the present disclosure.

Before the present disclosure is described in detail, it should be noted that similar elements are indicated as the same reference numeral in the following description.

The following description relates to specific embodiments in combination with figures which may implement the present disclosure. Representations of directions, such as up, down, front, rear, left, right and the like, in the present disclosure are only the directions shown in the figures. Therefore, representations of directions are only used for explanation, but are not used to limit the present disclosure.

Figure 2:
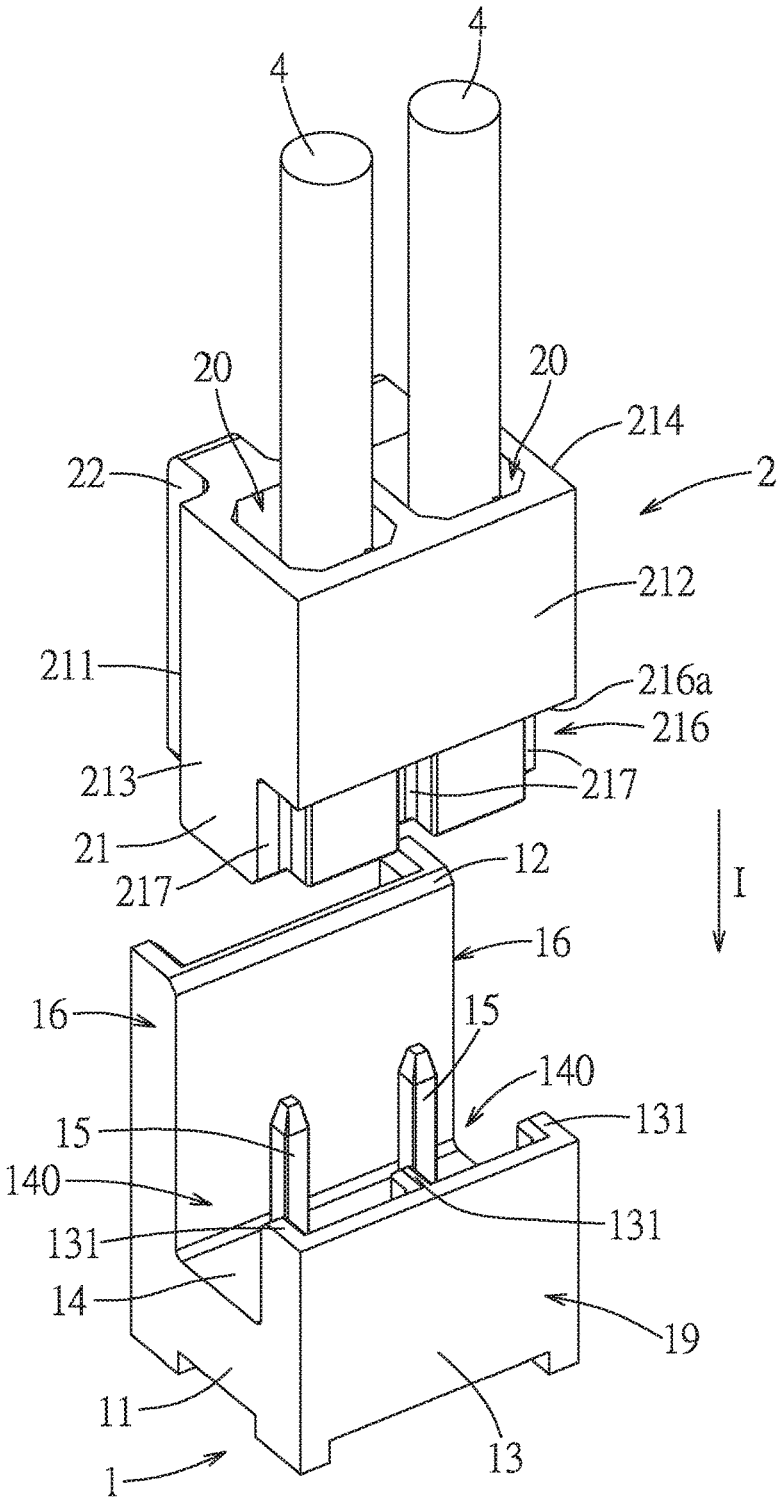
FIG. 2 is an exploded perspective view of the first embodiment from another angle.
Figure 3:
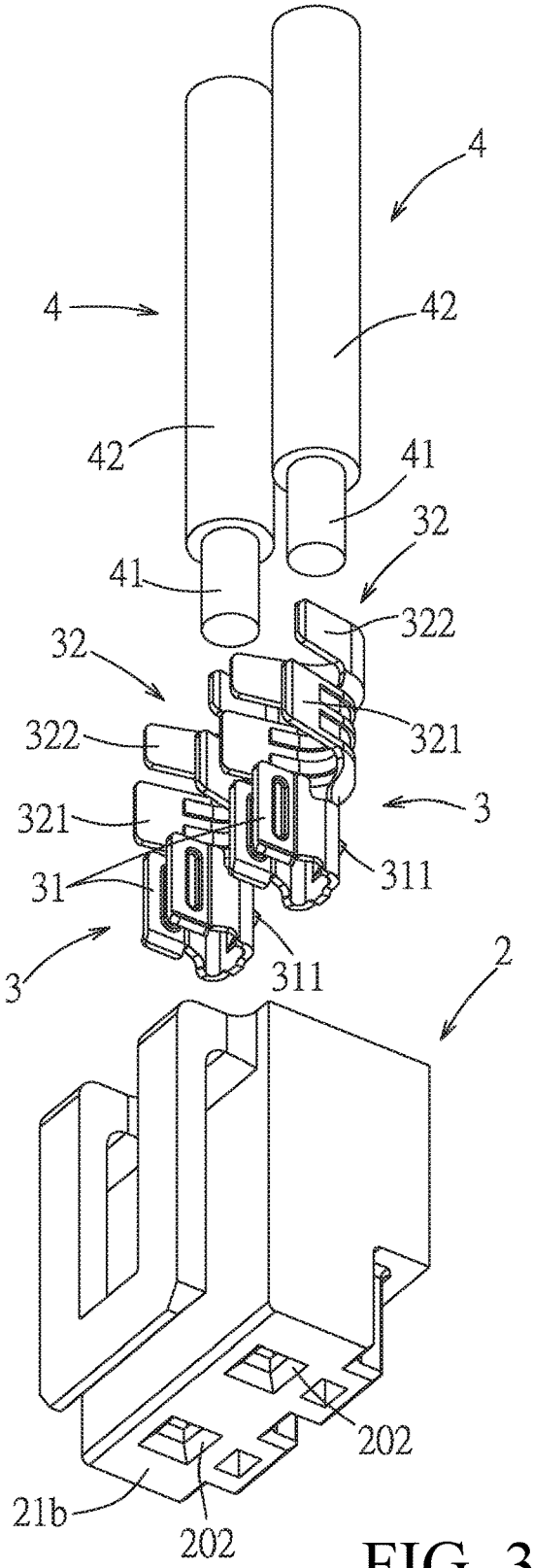
FIG. 3 is an exploded perspective view of a plug connector, two plug terminals and two cables of the first embodiment.

Referring to FIG. 1, FIG. 2 and FIG. 3, a first embodiment of an electrical connection device of the present disclosure comprises a receptacle connector 1 and a plug connector 2 which are mated along an inserting direction I (an up-down direction shown in the figures).

The receptacle connector 1 comprises a receptacle body 110, a front guide-positional limiting portion 121, a rear guide-positional limiting portion 19 and a first latching member 122. The receptacle body 110 comprises a base 11, a front wall 12 and a rear wall 13 which extend upwardly from the base 11 and are spaced apart in a front-rear direction and two side walls 16 respectively positioned on left and right sides, the base 11, the front wall 12, the rear wall 13 and the side walls 16 cooperate to define a plug receiving space 14, each side wall 16 is formed with a side opening 140 communicating with the plug receiving space 14. In the embodiment, the front guide-positional limiting portion 121 comprises the front wall 12, two front guide-positional limiting pieces 121*a* protruding forwardly from an outer wall surface of the front wall 12 and extending along the inserting direction I and a guide groove 121*b* which is defined cooperatively by the two front guide-positional limiting pieces 121*a* and the front wall 12 and extends along the inserting direction I; and the first latching member 122 is configured as a latch block and positioned within the guide groove 121*b* and between the two front guide-positional limiting pieces 121*a*. In an embodiment, preferably, the two front guide-positional limiting pieces 121*a* may be respectively aligned with the two side walls 16, but may be not aligned with the side walls 16. In an embodiment, preferably, the front wall 12 is higher than the rear wall 13, but the present disclosure is not limit to this. In an embodiment, preferably, the latch block of the first latching member 122 is configured to have an inclined guide surface 122*a* positioned above along the inserting direction I and a latching surface 122*b* positioned at a lower end along the inserting direction I, the latching surface 122*b* is configured as a sloped surface with a large angle of inclination.

The rear guide-positional limiting portion 19 comprises the rear wall 13 of the receptacle body 110 and at least one rear guide-positional limiting piece 131 formed to the rear wall 13 and extending along the inserting direction I, in the illustrated embodiment, the rear guide-positional limiting portion 19 comprises the three rear guide-positional limiting pieces 131 formed to the rear wall 13 and protruding inwardly toward the plug receiving space 14. Preferably, the left and right rear guide-positional limiting pieces 131 of the three rear guide-positional limiting pieces 131 are aligned with the two side walls 16, the third rear guide-positional limiting piece 131 is positioned between the left and right rear guide-positional limiting pieces 131, but the left and right rear guide-positional limiting pieces 131 also may be not aligned with the side walls 16. The receptacle connector 1 further comprises two receptacle terminals 15 provided to the base 11 and positioned within the plug receiving space 14.

Figure 4:
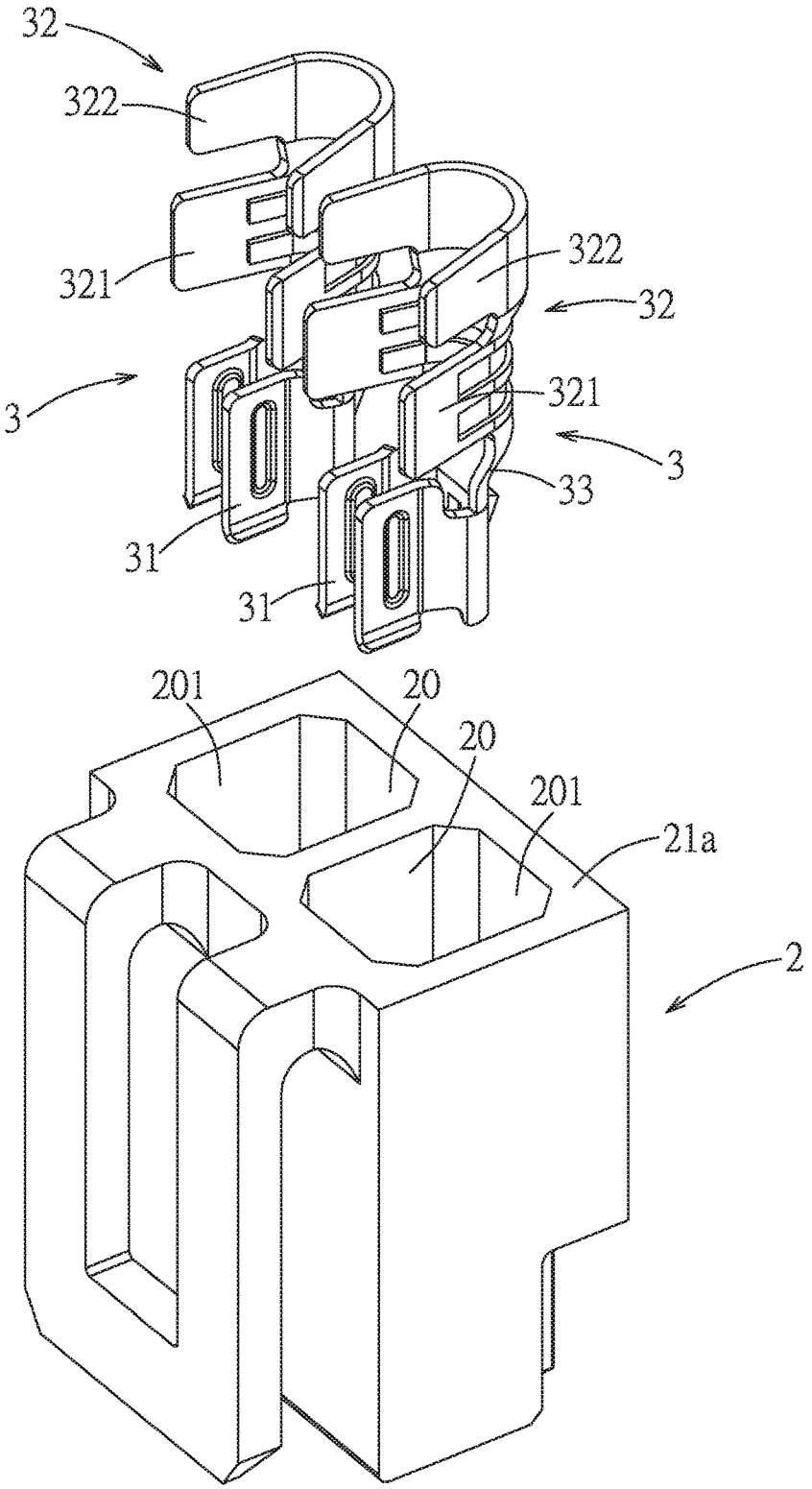
FIG. 4 is an exploded perspective view of a plug body of the plug connector and two plug terminals of the first embodiment.
Figure 5:
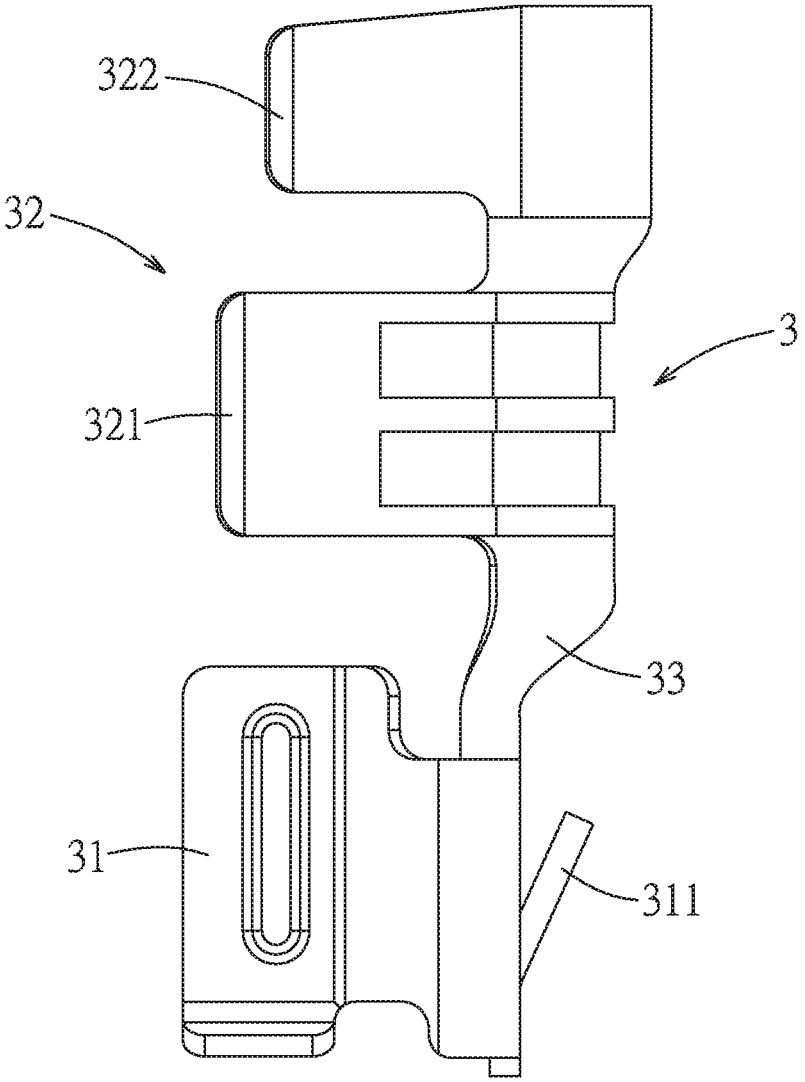
FIG. 5 is a side view of the plug terminal of the first embodiment.
Figure 6:
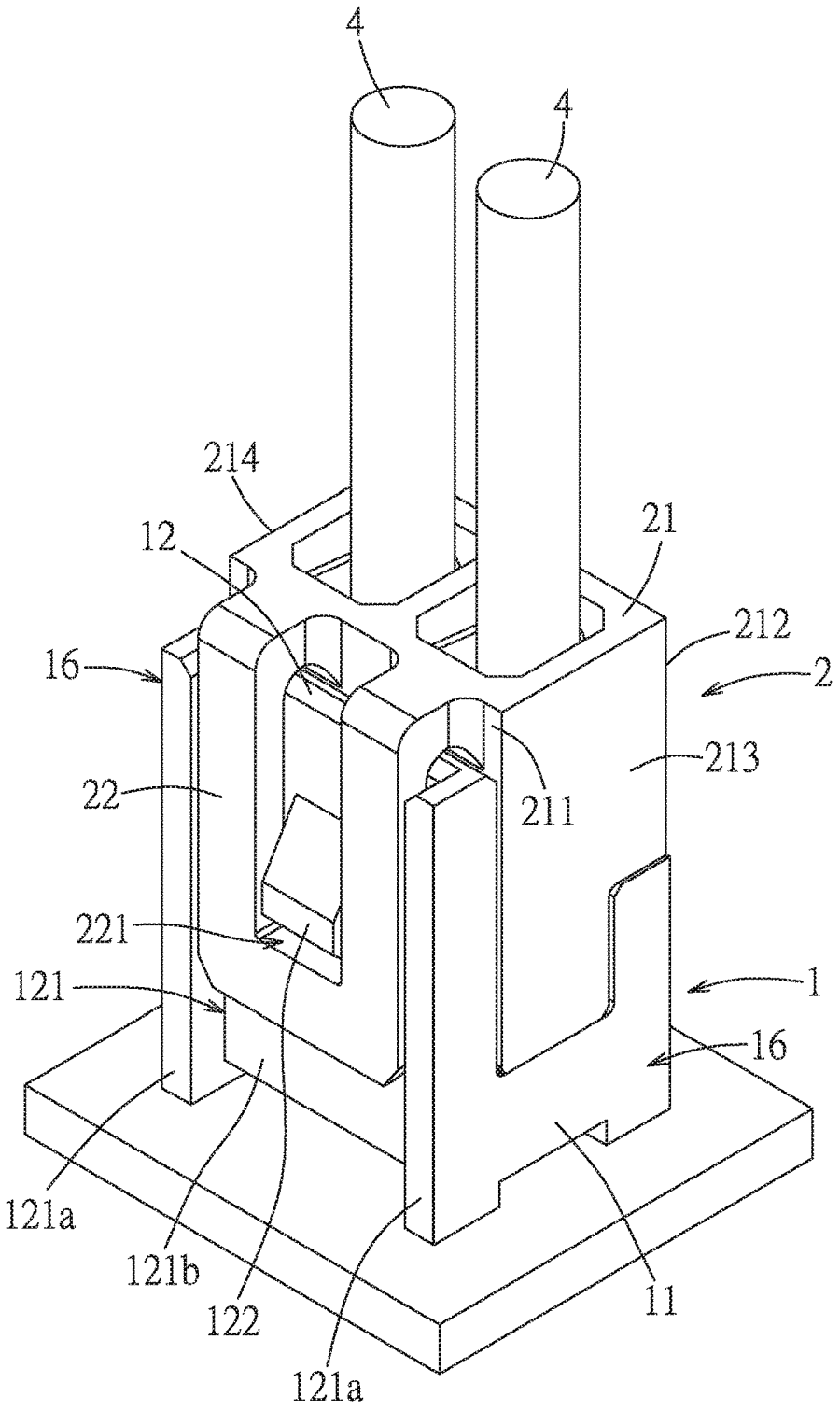
FIG. 6 is a perspective view that the plug connector in the first embodiment mates with a receptacle connector.
Figure 7:
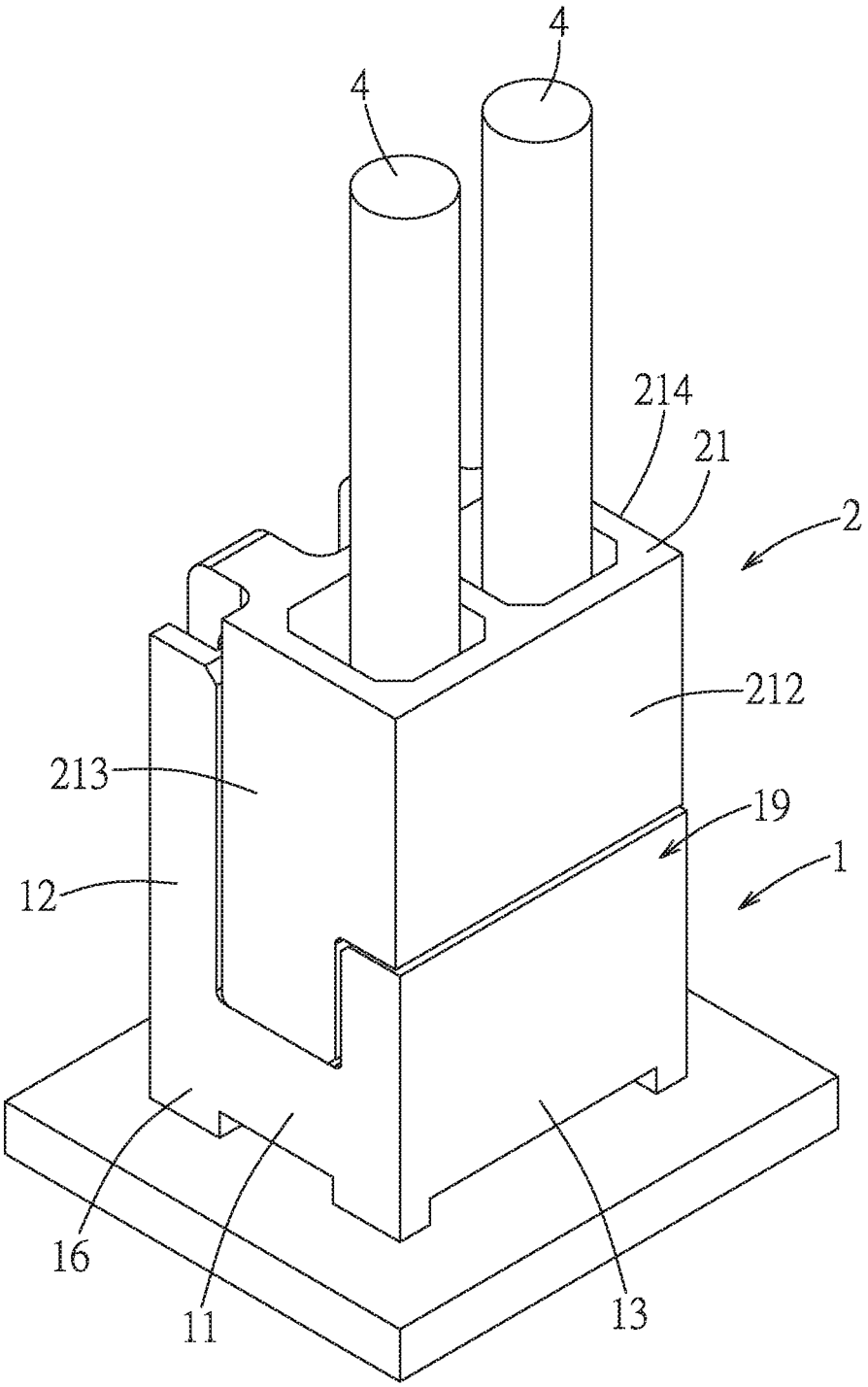
FIG. 7 is a perspective view that the plug connector in the first embodiment mates with the receptacle connector from another angle.

The plug connector 2 comprises a plug body 21 and a second latching member 22. The plug body 21 has a front wall 211, a rear wall 212, left and right side walls 213, 214. In addition, the plug body 21 further has a mating end surface 21*b* for facing the receptacle connector 1 when mating and a back end surface 21*a* opposite to the mating end surface 21*b*. The plug body 21 is provided with two terminal grooves 20 passing through the back end surface 21*a* and the mating end surface 21*b* of the plug body 21 along the inserting direction I, each terminal groove 20 has a mating insertion hole 202 (see FIG. 3) toward the mating end surface 21*b* and a terminal mounting hole 201 (see FIG. 4) toward the back end surface 21*a*, the terminal mounting holes 201 are used for the insertion of plug terminals 3 mounted with cables 4, which will be described later.

The second latching member 22 is integrally provided to the front wall 211 of the plug body 21, and spaced apart from the front wall 211, In the embodiment, the second latching member 22 is a generally U-shaped structure, the U-shaped structure defines a latching groove 221, both back ends of the U-shaped structure of the second latching member 22 extend toward the back end surface 21*a* to connect with the front wall 211 of the plug body 21 and the U-shaped structure extends toward the mating end surface 21*b* and is spaced apart from the front wall 211 of the plug body 21. And a region of the rear wall 212 of the plug body 21 generally corresponding to the rear wall 13 of the receptacle connector 1 is formed with a recessed portion 216, the recessed portion 216 is recessed relative to a surface of the rear wall 212 to form a step portion 216*a*, and the recessed portion 216 further comprises three guide recessed grooves 217 recessed deeper along the inserting direction I, two of the three guide recessed grooves 217 are exposed to the left, right side walls 213, 214 of the plug body 21, respectively, the other guide recessed groove 217 is provided between the aforementioned two guide recessed grooves 217, positions of the three guide recessed grooves 217 respectively correspond to the three rear guide-positional limiting pieces 131 of the rear wall 13 of the receptacle connector 1 and the three rear guide-positional limiting pieces 131 may slip in and may be received in the three guide recessed grooves 217 respectively.

Referring to FIG. 3 to FIG. 5 and FIG. 9, the two plug terminals 3 are used to respectively fix to end segments of the two cables 4 and mount in the two terminal grooves 20 of the plug connector 2. Each plug terminal 3 comprises a mating portion 31, a tail portion 32, and a stepped connecting portion 33. Specifically, the tail portion 32 has a conductor fixed section 321 and an insulator fixed section 322 which are connected, the insulator fixed section 322 is used to clamp and fix a portion of the cable 4 covered with an insulation layer 42, and the conductor fixed section 321 is used to clamp and fix a section of the cable 4 which the insulation layer 42 is removed and the conductor 41 is exposed. The mating portion 31 is a generally clamp-shaped structure, the stepped connecting portion 33 obliquely extends to connect the mating portion 31 and the tail portion 32. When the plug terminal 3 is mounted in the terminal groove 20, the tail portion 32 is positioned within the terminal mounting hole 201, the mating portion 31 is positioned to the mating insertion hole 202 of the terminal groove 20, and provision of the oblique structure of the stepped connecting portion 33 makes the mating portion 31 close to the front wall 211 of the plug body 21 relative to the tail portion 32 and the tail portion 32 close to the rear wall 212 of the plug body 21 relative to the mating portion 31.

Figure 8:
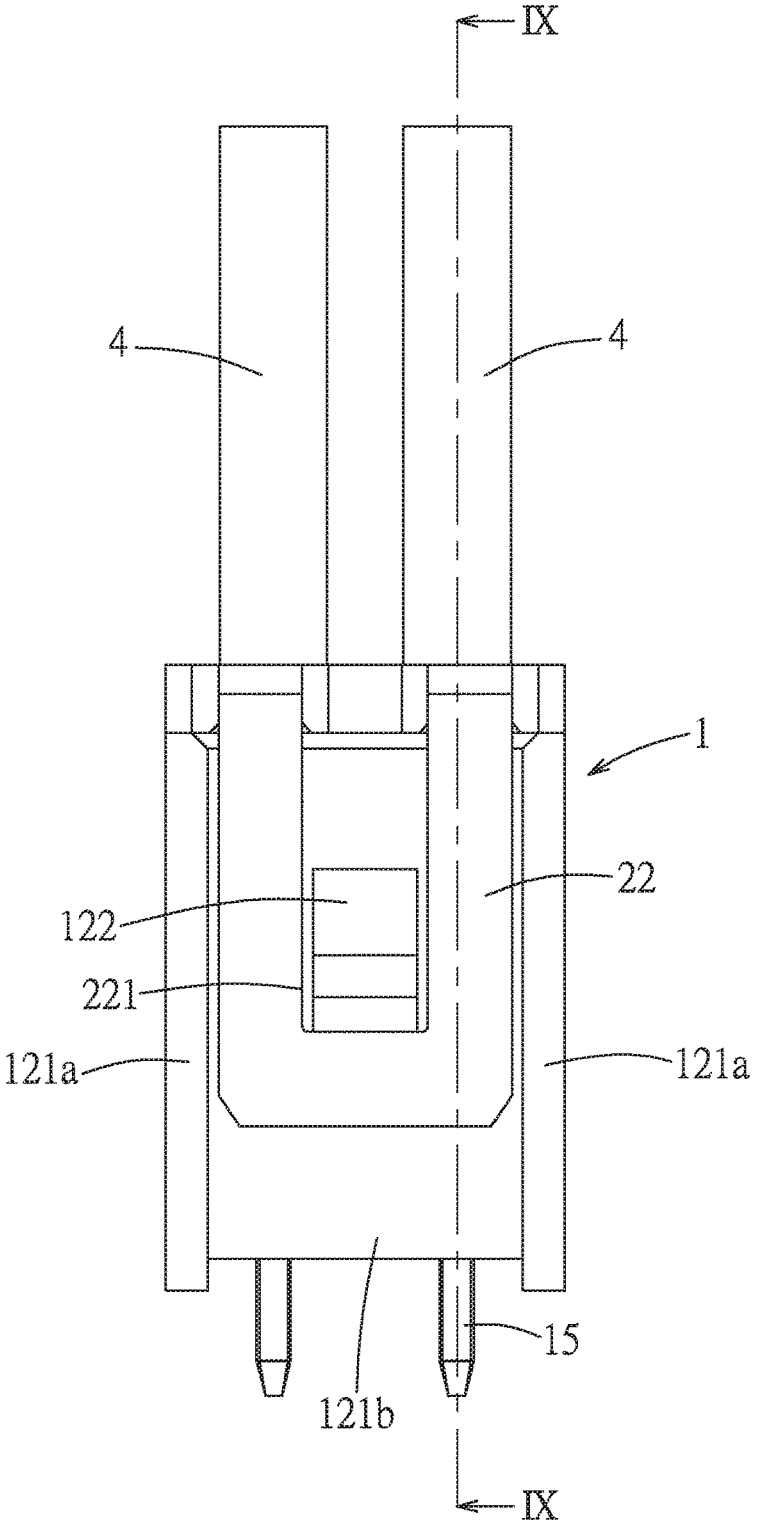
FIG. 8 is a front view that the plug connector in the first embodiment mates with the receptacle connector.

Referring to FIG. 1, FIG. 2 and FIG. 6 to FIG. 8, when inserting, the plug body 21 of the plug connector 2 is inserted into the plug receiving space 14 of the receptacle connector 1 along the inserting direction I and limited between the front wall 12 of the front guide-positional limiting portion 121 and the rear wall 13 of the rear guide-positional limiting portion 19 in the front-rear direction, during the insertion of the plug connector 2 into the receptacle connector 1, firstly, the front wall 12 of the receptacle connector 1 extends between the front wall 211 and the second latching member 22 of the plug connector 2 and the second latching member 22 is inserted into the guide groove 121*b*, and both sides of the second latching member 22 are limited by the two front guide-positional limiting pieces 121*a* in a left-right direction and guided by the insertion along the inserting direction Ito slip downwardly along the guide groove 121*b*, until the second latching member 22 is guided by the inclined guide surface 122*a* of the latch block of the first latching member 122 so that the second latching member 22 is elastically deformed, after passing the first latching member 122, the latching groove 221 of the second latching member 22 and the latching surface 23*b* at the lower end of the latch block of the first latching member 122 form a latching due to elastic recovery of the second latching member 22, as shown in FIG. 8, the first latching member 122 is positioned within the latching groove 221 of the second latching member 22 as latching and positional limiting in the inserting direction I, and the latching surface 122*b* with the large angle of inclination may prevent the latch block of the first latching member 122 from being easily separated from the latching groove 221 of the second latching member 22. In addition, in the process of inserting, the rear wall 13 of the base 11 of the receptacle connector 1 is positioned within the recessed portion 216 of the plug connector 2 and the three rear guide-positional limiting pieces 131 of the receptacle connector 1 also respectively slip into the three guide recessed grooves 217 of the plug connector 2 as positional limiting in left-right direction and inserting guidance along the inserting direction I. And a top edge of the rear wall 13 of the receptacle body 110 may abut against the step portion 216*a* of the recessed portion 216 of the plug body 21, which acts as a positioning position for completion of insertion, but the top edge of the rear wall 13 of the receptacle body 110 is not required to abut against the step portion 216*a* of the recessed portion 216 of the plug body 21, it may be also that the mating end surface 21*b* of the plug connector 2 may abut against the base 11 of the receptacle connector 1 as the positioning position for completion of insertion. After the insertion is completed, the two side walls 213 of the plug connector 2 are exposed to the side openings 140 at both sides of the receptacle connector 2, preferably, the two side walls 213 of the plug connector 2 are generally flush with the two side walls 16 of the receptacle connector 1, also, the rear wall 13 of the base 11 of the receptacle connector 1 is positioned within the recessed portion 216 of the plug connector 2, preferably, the rear wall 212 of the plug connector 2 is also generally flush with the rear wall 13 of the receptacle connector 1.

Figure 9:
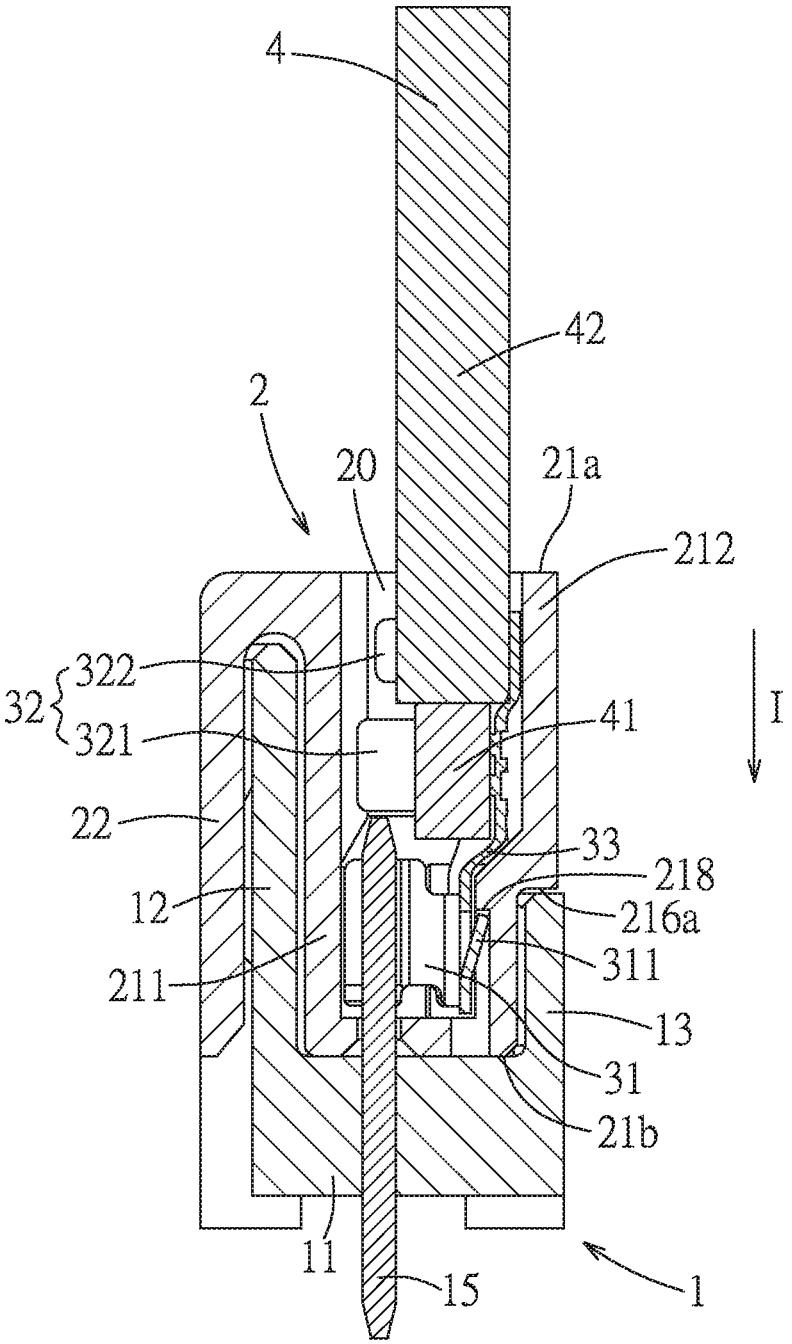
FIG. 9 is a cross-sectional view taken along a line IX-IX in FIG. 8.

And at the part of the receptacle terminal 15, referring to FIG. 9, when the plug connector 2 mates with the receptacle connector 1, the receptacle terminal 15 of the receptacle connector 1 extends into the mating insertion hole 202 of the plug connector 2 and enters into the clamp-shaped structure of the mating portion 31 of the plug terminal 3 to contact with the mating portion 31, so that the plug terminal 3 contacts with electrically connected with the receptacle terminal 15.

In the present disclosure, by the provision of the second latching member 22 of the plug connector 2 and the front guide-positional limiting portion 121 of the receptacle connector 1, when the plug connector 2 mates with the receptacle connector 1, besides the front guide-positional limiting portion 121 may guide the second latching member 22, the front guide-positional limiting portion 121 may limit the second latching member 22 in the left-right direction, so that the plug connector 2 can be inserted into the receptacle connector 1 accurately and stably. In addition, the provision of the recessed portion 216 of the plug connector 2 and the rear guide-positional limiting pieces 131 of the receptacle connector 1 may also function of guiding the mating of the receptacle connector 1 with the plug connector 2 and positional limiting, by that the rear guide-positional limiting portion 19 of the receptacle connector 1 engages with and positioned within the recessed portion 216 of the plug connector 2, and in turn the rear wall 212 of the plug connector 2 is generally flush with the rear wall 13 of the receptacle connector 1, and the left, right side walls 213, 214 of the plug connector 2 are respectively positioned in the two side openings 140 of the receptacle connector 1, the left, right side walls 213, 214 of the plug connector 2 are respectively flush with the left, right side walls 16 of the receptacle connector 1, a whole dimension of the electrical connection device is reduced.

And at the part of the plug terminal 3, referring to FIG. 9, in the present disclosure, by the provision of the stepped connecting portion 33, when the mating portion 31 of the plug terminal 3 mates with the receptacle terminal 15, the conductor 41 of the cable 4 is offset from the receptacle terminal 15 in the inserting direction I without contact, in other words, the conductor 41 of the cable 4 and the receptacle terminal 15 may allowed to overlap in a direction perpendicular to the inserting direction I but do not contact with each other, which in turn helps to make the dimension of the plug connector 2 short; moreover, in the present disclosure, by the provision of the stepped connecting portion 33 of the plug terminal 3 , the rear wall 212 of the plug body 21 can have enough space to form the recessed portion 216 to make the position of the recessed portion 216 correspond to the position of the mating portion 31 of the plug terminal 3. In addition, as shown in FIG. 9, in the embodiment, a latching step portion 218 positioned within the mating insertion hole 212 is further formed in the terminal groove 20 of the plug body 21, the mating portion 31 of each plug terminal 3 is formed with a latching member 311 protruding outwardly and being latched to the corresponding latching step portion 218, so each the plug terminal 3 can be firmly mounted in the plug connector 2.

Figure 10:
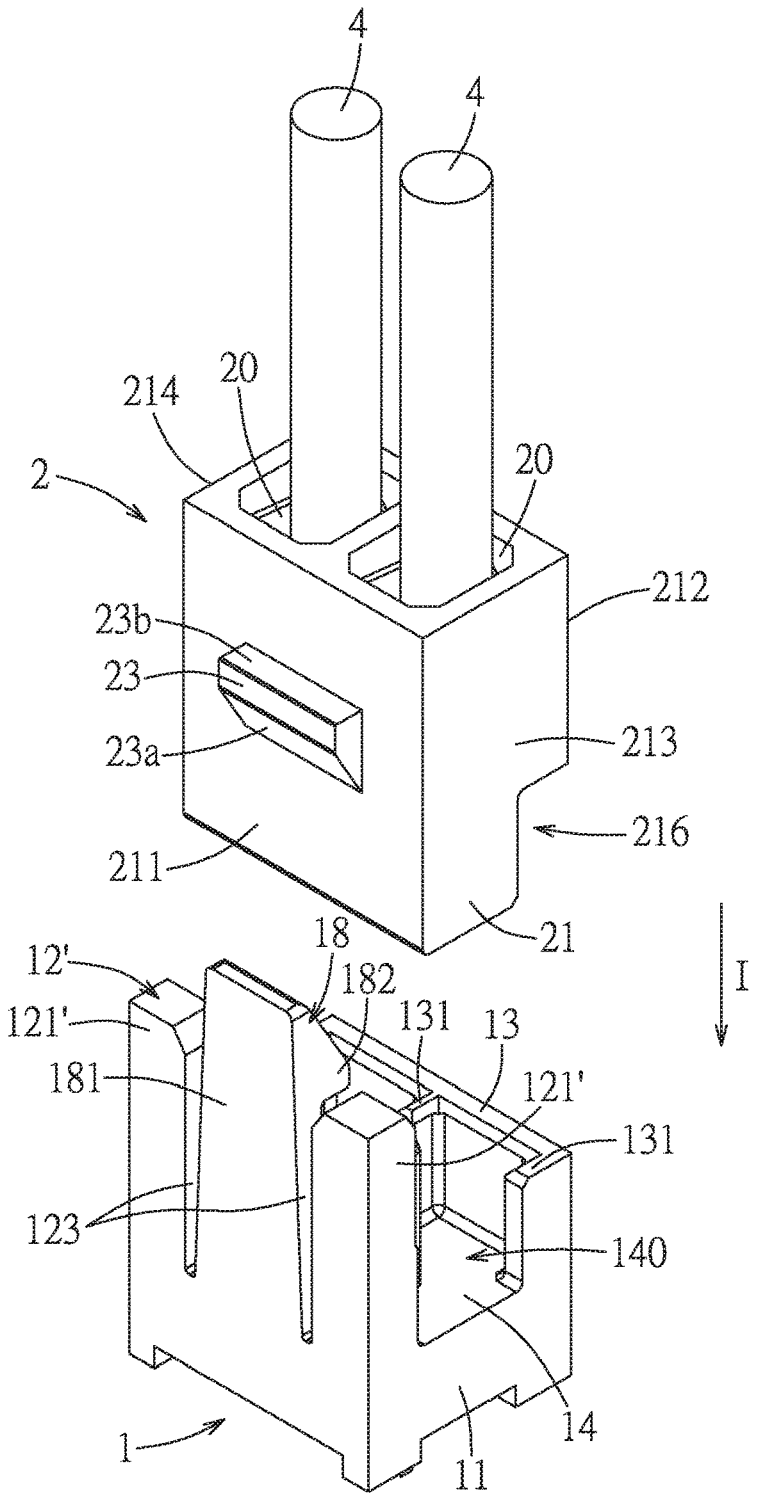
FIG. 10 is an exploded perspective view of a second embodiment of the electrical connection device of the present disclosure.
Figure 11:
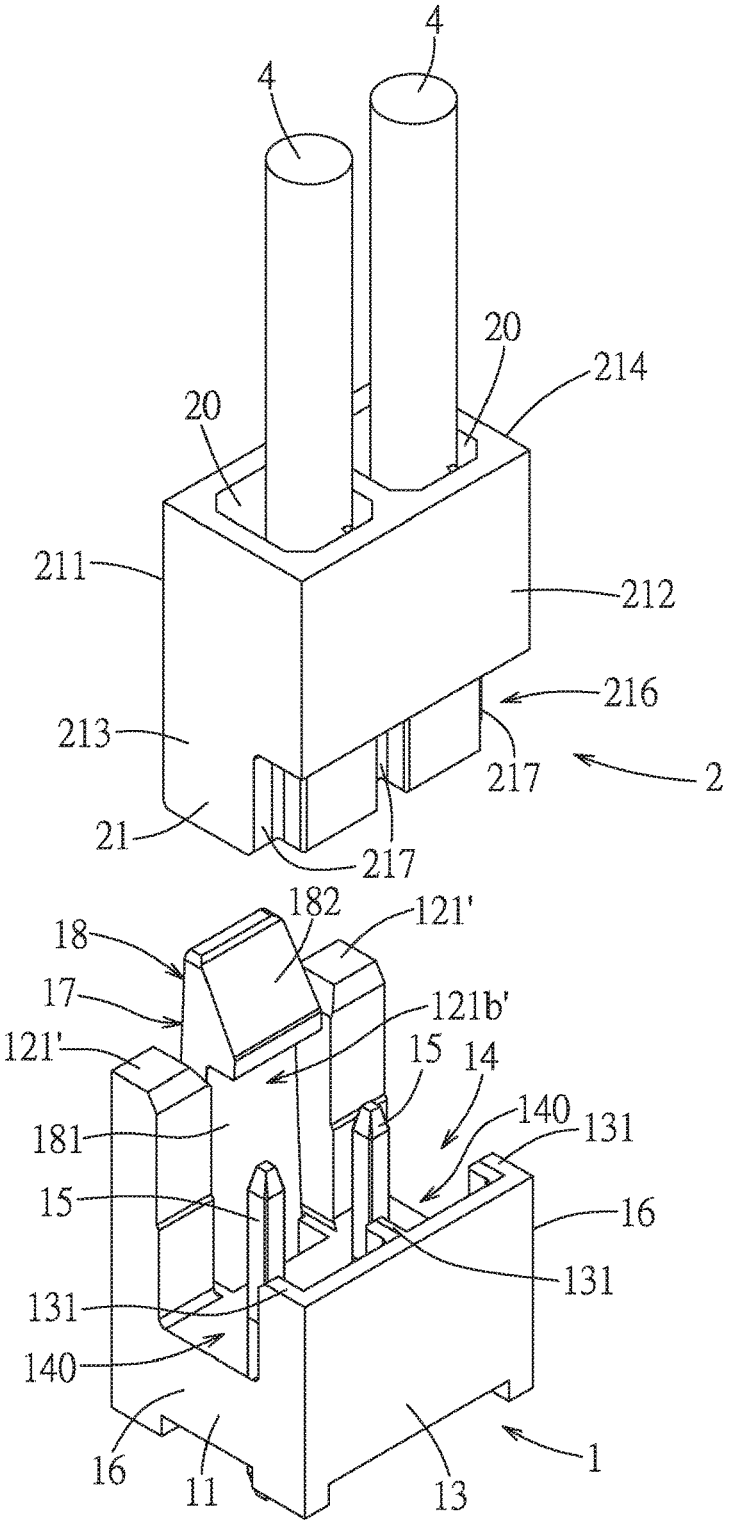
FIG. 11 is an exploded perspective view of the second embodiment from another angle.
Figure 12:
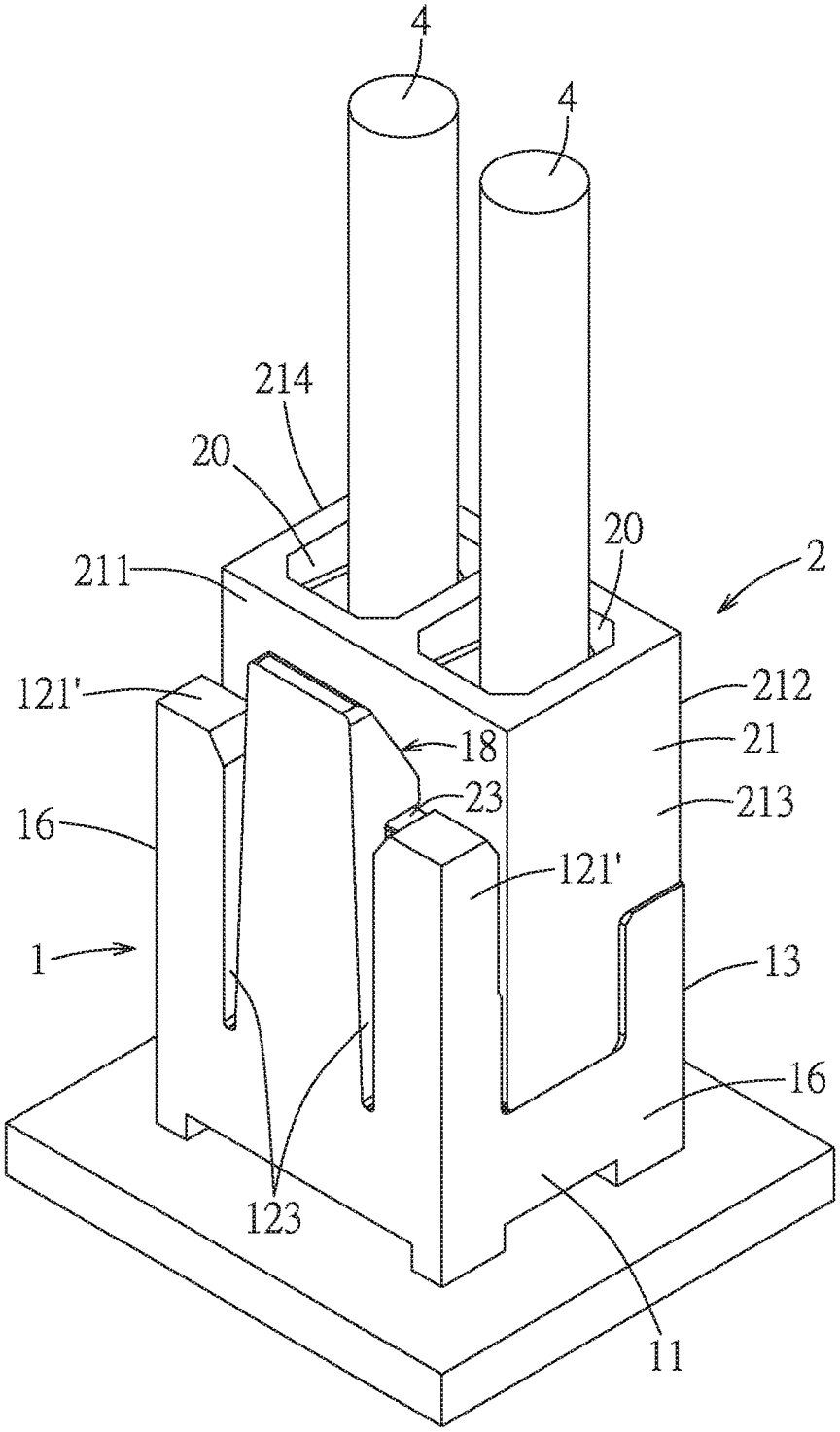
FIG. 12 is a perspective view that the plug connector in the second embodiment mates with the receptacle connector.

Referring to FIG. 10 to FIG. 12, a second embodiment of the electrical connection device of the present disclosure is illustrated, compared to the first embodiment, besides it is different in the front guide-positional limiting portion of the receptacle connector 1, a structure of the first latching member of the receptacle connector 1 and a structure of the second latching member of the plug connector 2 also are different.

In the second embodiment, the first latching member 18 of the receptacle connector 1 is an elastic hook structure formed to the front wall 12', the first latching member 18 comprises an elastic plate portion 181 and a latching block 182, more specifically, the front wall 12' of the receptacle connector 1 of the embodiment is formed with two grooves 123 along a direction parallel to the inserting direction I, the two grooves 123 split the front wall 12' into two side column portions 121' and the first latching member 18, the elastic plate portion 181 of the first latching member 18 is positioned between the two side column portions 121', the latching block 182 protrudes inwardly from an end of the elastic plate portion 181 toward the plug receiving space 14. And in the embodiment, a thickness of the elastic plate portion 181 is thinner than a thickness of the front wall 12' so that a region between an inner surface of the elastic plate portion 181 facing the plug receiving space 14 and opposite side surfaces of the two side column portions 121' is recessed, so as to define a guide groove 121*b'* of the front wall 12' positioned between an inner surface of the elastic plate portion 181 and the two side column portions 121' and inwardly toward the plug receiving space 14. And the second latching member 23 is a latch block integrally formed on the front wall 211 of the plug body 21 in the second embodiment, the latch block has an inclined guide surface 23*a* at the bottom and a latching surface 23*b* at an upper end, and a width of the latch block is smaller than a width of the guide groove 121*b'* of the front wall 12' in the left-right direction. The front guide-positional limiting portion 17 comprises the front wall 12' and the guide groove 121*b'* formed by the first latching member 18 and the two side column portions 121'.

Figure 13:
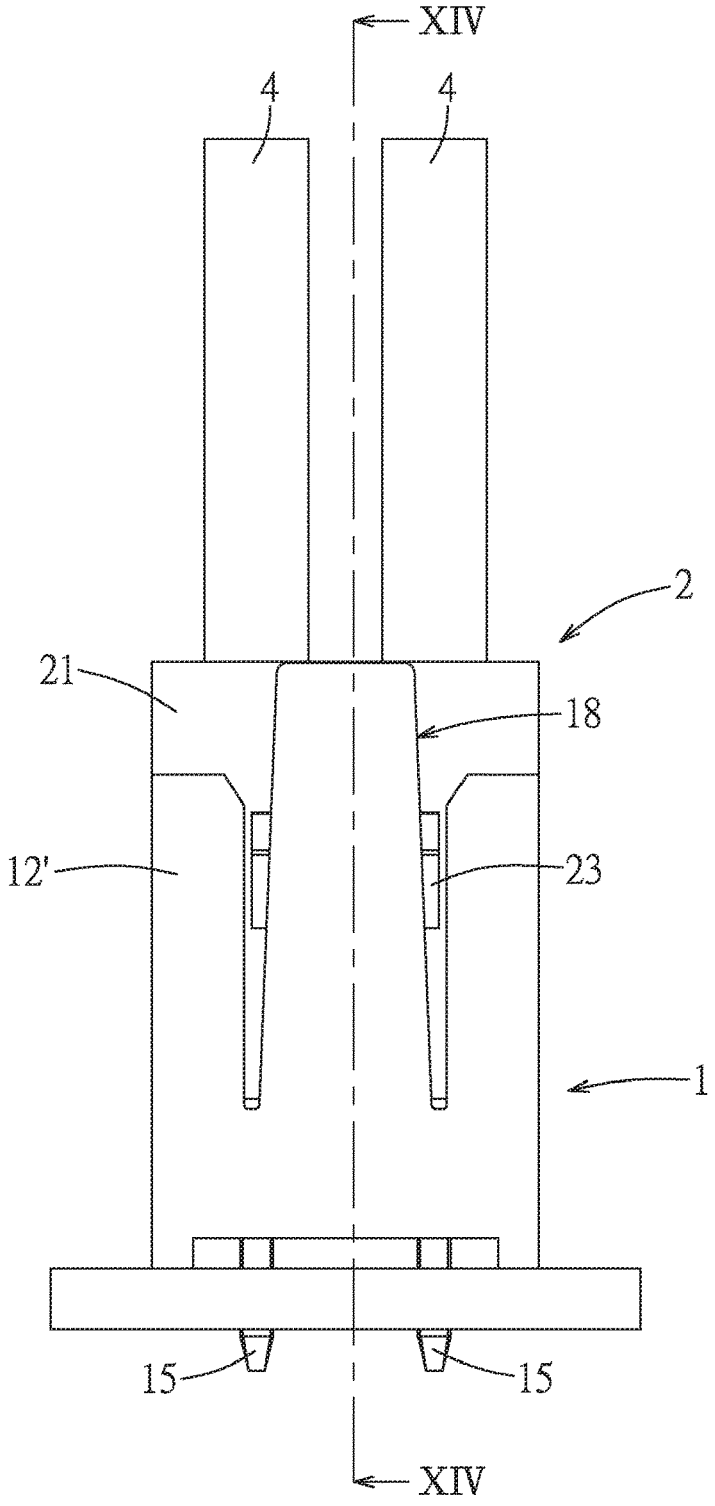
FIG. 13 is a front view that the plug connector in the second embodiment mates with the receptacle connector.
Figure 14:
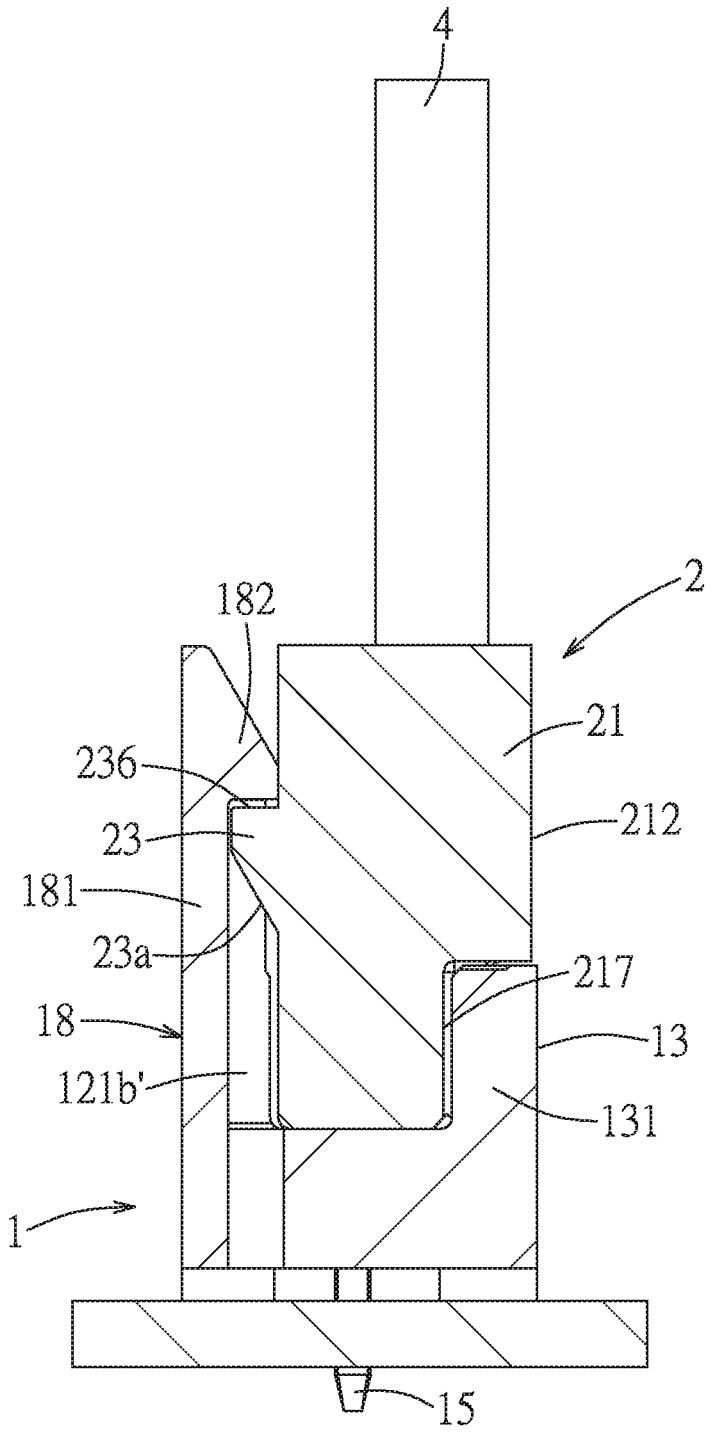
FIG. 14 is a cross-sectional view taken along a line XIV-XIV in FIG. 13.

In combination with referring to FIG. 13 and FIG. 14, when the plug connector 2 mates with the receptacle connector 1, guided by the inclined guide surface 23*a* of the latch block of the second latching member 23, the latching block 182 of the first latching member 18 is pushed to displace outwardly and the elastic plate portion 181 is elastically deformed outwardly, and then the latch block of the second latching member 23 enters into the guide groove 121*b'*, after the latch block of the second latching member 23 passes the latching block 182 of the first latching member 18, the elastic plate portion 181 rebound such that the latching block 182 is latched to the latching surface 23*b* at the upper end of the latch block of the second latching member 23, meanwhile, the plug body 21 of the plug connector 2 is received in the plug receiving space 14 of the receptacle connector 1, and the latch block of the second latching member 23 of the plug connector 2 is limited between the two side column portions 121' on both sides of the guide groove 121*b*' in the left-right direction and latched and limited by the first latching member 18 from above, so the mating of the plug connector 2 with the receptacle connector 1 is more stable and firm. Also, the guide recessed grooves 217 of the plug connector 2 are respectively guided and limited by the rear guide-positional limiting pieces 131 of the receptacle connector 1 such that the rear wall 13 of the receptacle connector 1 is received in the recessed portion 216 of the plug connector 2, and in turn the rear wall 212 of the plug connector 2 is generally flush with the rear wall 13 of the receptacle connector 1, and the left, right side walls 213, 214 of the plug connector 2 are respectively positioned to the two side openings 140 of the receptacle connector 1, the left, right side walls 213, 214 of the plug connector 2 are respectively flush with the left, right side walls 16 of the receptacle connector 1, which in turn the whole dimension of the electrical connection device is reduced. Also, in the illustrated embodiment, see FIG. 14, the latching block 182 and the latching surface 23*b* at the upper end of the latch block are latched horizontally, which thus has a stronger latch force, but they may be latched obliquely as the first embodiment.

The above described are only the embodiments of the present disclosure, which cannot limit the scope of the implementation of the present disclosure, that is, simple equivalent variations and modifications made according to the scope of the Claims and the description content of the present disclosure are still fallen within the scope of the present disclosure.

What is claimed is:

1. An electrical connection device, comprising:

a receptacle connector comprising a receptacle body, a front guide-positional limiting portion, a rear guide-positional limiting portion and a first latching member, the receptacle body comprising a base, a front wall and a rear wall which extend upwardly from the base and two side walls respectively positioned on left and right sides, the base, the front wall and the rear wall cooperating to define a plug receiving space, the two side walls each being formed with a side opening communicating with the plug receiving space, the front guide-positional limiting portion comprising the front wall and a guide groove positioned to the front wall and extending along an inserting direction, the rear guide-positional limiting portion comprising the rear wall and at least one rear guide-positional limiting piece formed to the rear wall, the first latching member being provided to the front guide-positional limiting portion; and a plug connector removably mating with the receptacle connector along the inserting direction and comprising a plug body and a second latching member, the plug body having a front wall, a rear wall, two side walls respectively positioned on left and right sides, the rear wall of the plug body being recessed to form a recessed portion, the recessed portion being formed with a guide recessed groove into which the rear guide-positional limiting piece of the receptacle connector extends, the second latching member being provided to the front wall of the plug body, when the plug connector mates with the receptacle connector, the plug body being inserted into the plug receiving space of the receptacle body and limited between the front wall of the front guide-positional limiting portion and the rear wall of the rear guide-positional limiting portion, the second latching member of the plug connector being latched to the first latching member of the receptacle connector and limited by the front guide-positional limiting portion, the rear guide-positional limiting piece of the receptacle body extending into the guide recessed groove and the rear wall engaging with the recessed portion of the plug body, the rear wall of the plug connector being generally flush with the rear wall of the receptacle connector, the two side walls of the plug body being respectively exposed to the two side openings of the receptacle body and generally flush with the two side walls of the receptacle body.

2. The electrical connection device of claim 1, wherein the front guide-positional limiting portion of the receptacle body comprises two front guide-positional limiting pieces extending forwardly respectively from the front wall of the receptacle body, the two front guide-positional limiting pieces and the front wall cooperate to define the guide groove, the first latching member is positioned between the two front guide-positional limiting pieces, when the plug connector mates with the receptacle connector, the second latching member is positioned between the two front guide-positional limiting pieces, and the front wall of the receptacle body is positioned between the front wall of the plug connector and the second latching member.

3. The electrical connection device of claim 2, wherein the first latching member of the receptacle connector is a latch block protruding from the front wall of the receptacle body, the second latching member of the plug connector defines a latching groove, when the second latching member is latched to the first latching member, the latch block is positioned within the latching groove.

4. The electrical connection device of claim 3, wherein the second latching member is a general U-shaped structure and surrounds to define the latching groove, and both back ends of the U-shaped structure extend backwardly to connect with the front wall of the plug connector.

5. The electrical connection device of claim 1, wherein the front wall of the receptacle body is formed with two grooves, the two grooves split the front wall of the receptacle body into two side column portions and the first latching member positioned between the two side column portions, the first latching member comprises an elastic plate portion and a latching block protruding inwardly from an end of the elastic plate portion toward the plug receiving space, the guide groove is formed between an inner surface of the elastic plate portion and the two side column portions; the second latching member is a latch block protruding from the front wall of the plug body.

6. The electrical connection device of claim 5, wherein a thickness of the elastic plate portion of the first latching member is thinner than a thickness of each of the two side column portions and a width of the second latching member in a left-right direction is smaller than a width between the two side column portions, when the plug connector mates with the receptacle connector, the second latching member of the plug connector is positioned with the guide groove and limited between the two side column portions.

7. The electrical connection device of claim 1, wherein the rear wall of the receptacle body is formed with the three rear guide-positional limiting pieces, the recessed portion of the plug connector is formed with the three guide recessed grooves.

8. The electrical connection device of claim 1, wherein the plug body is formed with a plurality of terminal grooves, each terminal groove has a terminal mounting hole and a mating insertion hole which are communicated, the plug connector further comprises plug terminals respectively for fixing to end segments of a pair of cables and mounting in the terminal grooves, each plug terminal comprises a mating portion positioned to the mating insertion hole, a tail portion for clamping and fixing one cable and a stepped connecting portion connecting the mating portion and the tail portion, the mating portion is close to the front wall of the plug body relative to the tail portion and the tail portion is close to the rear wall of the plug body relative to the mating portion, the receptacle connector further comprises receptacle terminals to respectively mate with the mating portions of the plug terminals, when the mating portion of the plug terminal mates with the receptacle terminal, the cable is offset from the receptacle terminal in the inserting direction without contact.

9. The electrical connection device of claim 8, wherein a position of the recessed portion corresponds to a position of the mating portion of the plug terminal.

10. The electrical connection device of claim 9, wherein the stepped connecting portion of each plug terminal extends obliquely.

* * * * *